United States Patent [19]

Snavely et al.

[11] Patent Number: 4,471,839

[45] Date of Patent: Sep. 18, 1984

[54] STEAM DRIVE OIL RECOVERY METHOD UTILIZING A DOWNHOLE STEAM GENERATOR

[75] Inventors: Earl S. Snavely, Arlington; Daniel N. Hopkins, Dallas, both of Tex.

[73] Assignee: Mobil Oil Corporation, New York, N.Y.

[21] Appl. No.: 488,514

[22] Filed: Apr. 25, 1983

[51] Int. Cl.[3] ..... E21B 43/36; E21B 43/24

[52] U.S. Cl. ..... 166/260; 166/59; 166/303

[58] Field of Search ..... 166/260, 261, 262, 256, 166/59, 57, 300, 302, 303

[56] References Cited

U.S. PATENT DOCUMENTS

| | | | |
|---|---|---|---|
| 3,198,249 | 8/1965 | Willman | 166/261 X |
| 3,266,572 | 8/1966 | Woodward | 166/260 |
| 3,285,336 | 11/1966 | Gardner | 166/260 X |
| 3,497,000 | 2/1970 | Hujsak et al. | 166/59 |
| 4,050,515 | 9/1977 | Hamrick et al. | 166/59 X |
| 4,336,839 | 6/1982 | Wagner et al. | 166/59 |

*Primary Examiner*—Stephen J. Novosad

*Attorney, Agent, or Firm*—A. J. McKillop; Michael G. Gilman; Malcolm D. Keen

[57] ABSTRACT

Viscous oil is recovered from a subterranean, viscous oil-containing formation by a steam flooding technique wherein steam is generated in a downhole steam generator located in an injection well by spontaneous combustion of a pressurized mixture of a water-soluble fuel such as sugars and alcohols dissolved in water and substantially pure oxygen. The generated mixture of steam and combustion gases pass through the formation, displacing oil and reducing the oil's viscosity and the mobilized oil is produced from the formation via a spaced-apart production well.

19 Claims, 1 Drawing Figure

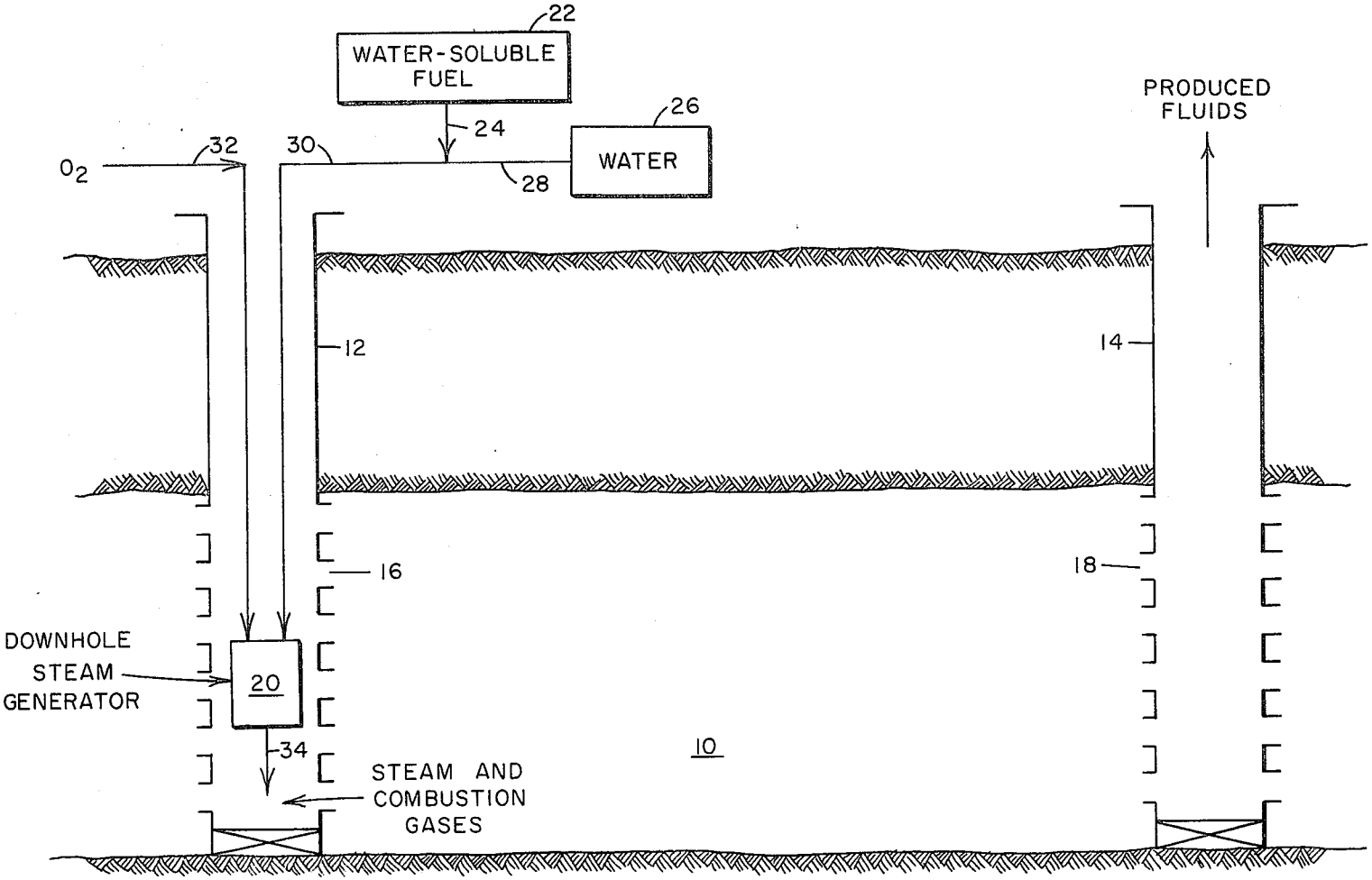
PRODUCED FLUIDS
14
18
10
26
WATER
22
WATER-SOLUBLE FUEL
24
28
30
32
$O_2$
12
16
20
34
STEAM AND COMBUSTION GASES
DOWNHOLE STEAM GENERATOR

STEAM DRIVE OIL RECOVERY METHOD UTILIZING A DOWNHOLE STEAM GENERATOR

FIELD OF THE INVENTION

The present invention concerns a steam drive oil recovery method wherein the steam is produced in a downhole steam generator by spontaneous combustion of a pressurized mixture of a water-soluble dissolved in water with substantially pure oxygen.

BACKGROUND OF THE INVENTION

Steam has been used in many different methods for the recovery of oil from subterranean, viscous oil-containing formations. The two basic processes using steam for the recovery of oil includes a "steam drive" process and "huff and puff" steam processes. Steam drive involves injecting steam through an injection well into a formation. Upon entering the formation, the heat transferred to the formation by the steam lowers the viscosity of the formation oil, thereby improving its mobility. In addition, the continued injection of the steam provides the drive to displace the oil toward a production well from which it is produced. Huff and puff involves injecting steam into a formation through a well, stopping the injection of steam, permitting the formation to soak and then back producing oil through the original well.

Steam flooding operations for recovering heavy oil utilizing propane or diesel fired downhole steam generators are described in the articles "Steam Generators Work Long Periods Downhole", OIL AND GAS JOURNAL, July 5, 1982, pp. 76 and 78, and "West Coast For Project Results Discouraging", OIL AND GAS JOURNAL, Aug. 9, 1982, page 82.

The present invention provides an improved steam flood recovery process wherein steam is generated in a downhole generator located in the injection well adjacent the oil-containing formation by spontaneous combustion of a pressurized mixture of a water-soluble fuel dissolved in water with substantially pure oxygen.

SUMMARY OF THE INVENTION

The process of our invention involves a method of recovering viscous oil from a subterranean, permeable, viscous oil-containing formation, said formation being penetrated by at least one injection well and at least one spaced-apart production well, said wells in fluid communication with a substantial portion of the formation comprising mixing a water-soluble fuel with water, injecting said mixture of water-soluble fuel and water under pressure into a steam generation zone located in the injection well, injecting substantially pure oxygen under pressure into said steam generation zone via said injection well which contacts the pressurized mixture of water-soluble fuel and water thereby effecting spontaneous combustion of said fuel to generate a mixture of steam and combustion gases that pass through the formation, displacing oil and reducing the oil's viscosity, and recovering fluids incuding oil from the formation via the production well until the fluid being recovered contains an unfavorable ratio of oil to water. Preferred water-soluble fuels include sugar such as molasses and raw sugars beet extract (juice) and alcohols such as methanol, ethanol, propanol, and iso-propanol.

BRIEF DESCRIPTION OF THE DRAWING

The drawing illustrates a vertical plane view of a subterranean formation penetrated by an injection well, and a downhole steam generator in the injection well adjacent the formation that subjects the formation to a steam flooding technique.

DESCRIPTION OF THE PREFERRED EMBODIMENT

Briefly, the oil recovery process of our invention involves a steam flooding method for recovering viscous oil in which steam is generated in a downhole steam generator positioned in the injection well by spontaneous combustion therein of a pressurized mixture of a water-soluble fuel dissolved in water and substantially pure oxygen.

The process is better understood by referring to the drawing which illustrates a subterranean, permeable, viscous oil-containing formation 10 penetrated by at least one injection well 12 and at least one spaced-apart production well 14. The injection well 12 and the production well 14 are in fluid communication with a substantial portion of the formation 10 by means of perforations 16 and 18. A downhole steam generator 20 is positioned in the injection well 12, preferably about midway of the vertical thickness of the formation 10. The downwhole steam generator 20 comprises any suitable type of combustion zone in which substantially pure oxygen is contacted with a water-soluble fuel dissolved in water thereby effecting spontaneous combustion of the fuel to generate a mixture of steam and combustion gases. A water-soluble fuel from a source 22 is transported via line 24 and comingled with water from source 26 via line 28. The mixture of the water-soluble fuel and water is introduced under pressure into the downwhole steam generator 20 via line 30 where it is contacted with substantially pure oxygen under pressure from line 32 thereby effecting spontaneous combustion of the fuel to generate a mixture of steam and combustion gases. The downhole steam generator is operated at pressures within the range of 1000 to 3000 psi and at a temperature within the range of 550° F. to 700° F. The steam and combustion gases exits the downhole steam generator 20 via line 34 and pass into formation 10 by means of perforations 16. The steam passes through the formation 10 reducing the oil's viscosity and displacing the oil toward production well 14 from which fluids including oil are produced. Generation of steam is continued and fluids are produced from production well 14 until the fluids being recovered comprise an unfavorable ratio of oil to water.

Any water-soluble fuel can be employed in the process which in contact with substantially pure oxygen under pressure will spontaneously ignite. Suitable water-soluble fuels include sugars such as molasses and raw sugar beet extract (juice) and alcohols such as methanol, ethanol, propanol, and iso-propanol and combinations thereof. Of these raw sugar beet extract (juice) is particularly preferred for economical reasons. Generally, the concentration of water-soluble fuel will be from about 10 to about 33 weight percent which will depend upon the heating value of the fuel. For raw sugar beet extract (juice) the preferred concentration is about 20 weight percent.

Since the fuel introduced into the downhole steam generator is liquid and not gaseous, no compression is necessary to inject it downhole thereby eliminating the energy required for compression as required if a gaseous fuel were used. In addition, since the water-soluble fuel dissolved in water is a single phase, heat transfer in the combustion zone of the downhole steam generator 20 to generate steam is more efficient and control of steam generation is more flexible. Also, use of substantially pure oxygen decreases the amount of combusiton gases formed by 80% compared to using air. Another advantage of this process is that combustion and steam generation occurs in one step in the downhole steam generator 20.

The amount of oxygen introduced into a 10 million/-BTU/hr downhole steam generator is about 19 tons per day.

In another embodiment of the present invention, the recovery process may be conducted in a single well utilizing a conventional "push-pull" or "huff and puff" steam stimulation cycle. In this embodiment, the downhole steam generator is located in a single well that penetrates the oil-containing formation and is in fluid communication therewith. As previously described, spontaneous combustion of a pressurized mixture of a water-soluble fuel dissolved in water in contact with substantially pure oxygen is effected in a downhole steam generator located in the well adjacent to the oil-containing formation to generate steam and combustion gases. The steam and combustion gases pass through the oil-containing formation so that the oil is heated and reduced in viscosity. Generation of a mixture of steam and combustion gases is continued for a predetermined period of time or until the steam front propagates a predetermined distance of about 5 to 50 feet from the well. Thereafter, steam generation is terminated and the well is put into production wherein fluids including oil are recovered from the well. In addition, after steam generation has been terminated, the well may be shut-in to allow the formation to undergo a soak period which enables the steam in the formation to deliver heat to the in-place viscous oil prior to opening the well to production. The soak period is continued until portions of the viscous oil has received enough heat that the oil will flow more readily through the formation into the well. The steps of generating steam from the downhole steam generator followed by production may be repeated for a plurality of cycles.

While the invention has been described in terms of a single injection well and a single spaced apart production well, the method according to the invention may be practiced using a variety of well patterns. Any other number of wells, which may be arranged according to any patterns, may be applied in using the present method as illustrated in U.S. Pat. No. 3,927,716 to Burdyn et al, the disclosure of which is hereby incorporated by reference.

Although the present invention has been described with preferred embodiments, it is to be understood that modification and variations may be resorted to, without departing from the spirit and scope of this invention, as those skilled in the art will readily understand. Such variations and modifications are considered to be within the purview and scope of the appended claims.

What is claimed is:

1. In a method of recovering viscous oil from a subterranean, permeable, viscous oil-containing formation, said formation being penetrated by at least one injection well and at least one spaced-apart production well, said wells in fluid communication with a substantial portion of the formation, comprising:

(a) mixing a water-soluble fuel with water;

(b) injecting said mixture of water-soluble fuel dissolved in water under pressure into a steam generation zone in said injection well;

(c) concurrently with step (b), injecting substantially pure oxygen into said steam generation zone under pressure via said injection well which contacts the pressurized mixture of water-soluble fuel and water thereby effecting spontaneous combustion of said fuel to generate a mixture of steam and combustion gases that pass through the formation, displacing oil and reducing the oil's viscosity; and (d) recovering fluids including oil from the formation via the production well.

2. The method of claim 1 wherein the water-soluble fuel is selected from the group consisting of sugars and alcohols.

3. The method of claim 2 wherein the sugar comprises molasses.

4. The method of claim 2 wherein the sugar comprises raw sugar beet extract (juice).

5. The method of claim 1 wherein the water-soluble fuel is raw sugar beet extract (juice) and the raw sugar beet extract (juice) concentration is about 20 weight percent.

6. The method of claim 1 wherein the pressure in the steam generation zone is maintained within the range of 1000 to 3000 psi and the temperature is within the range of 550° F. to 700° F.

7. The method of claim 1 wherein the concentration of water-soluble fuel is within the range of about 10 to about 33 weight percent.

8. The method of claim 1 wherein the steam generation zone is located about midway the vertical distance of the oil-containing formation.

9. The method of claim 1 further including continuing step (d) until the fluids produced contain an unfavorable ratio of oil to water.

10. In a method for recovering oil from a subterranean, permeable, viscous oil-containing formation, said formation being penetrated by at least one well, said well in fluid communication with a substantial portion of the formation, comprising:

(a) mixing a water-soluble fuel with water;

(b) injecting said mixture of water-soluble fuel dissolved in water under pressure into a steam generation zone in said injection well; (c) injecting substantially pure oxygen into said steam generation zone under pressure via said well which contacts the pressurized mixture of water-soluble fuel and water thereby effecting spontaneous combustion of said fuel to generate a mixture of steam and hot combustion gases that pass through the formation, displacing oil and reducing the oil's viscosity;

(d) continuing injecting said pressurized mixture of water-soluble fuel dissolved in water and substantially pure oxygen for a predetermined period of time; and (e) thereafter, discontinuing fluid injection of step (d) and opening said well to production so that fluids including oil are recovered from the formation.

11. The method of claim 10 including repeating steps (b) through (e) for a plurality of cycles.

12. The method of claim 10 comrising the additional step of leaving the steam and hot combustion gases injected into the formation in step (c) in the formation for a soak period for a predetermined time interval prior to the fluid production in step (e).

13. The method of claim 10 wherein the water-soluble fuel is selected from the group consisting of sugars and alcohols.

14. The method of claim 13 wherein the sugar comprises molasses.

15. The method of claim 13 wherein the sugar comprises raw sugar beet extract (Juice).

16. The method of claim 10 wherein the water-soluble fuel is raw sugar beet extract (juice) and the raw sugar beet extract (juice) concentration is about 20 weight percent.

17. The method of claim 10 wherein the pressure in the steam generation zone is maintained within the range of 1000 to 3000 psi and the temperature is within the range of 550° F. to 700° F.

18. The method of claim 10 wherein the concentration of water-soluble fuel is within the range of about 10 to about 33 weight percent.

19. The method of claim 10 wherein the steam generation zone is located about midway the vertical distance of the oil-containing formation.

* * * * *